US010161724B2

(12) United States Patent
Walker et al.

(10) Patent No.: US 10,161,724 B2
(45) Date of Patent: Dec. 25, 2018

(54) SHAPED-CHARGE LINER WITH FOLD AROUND OPENING

(71) Applicant: HALLIBURTON ENERGY SERVICES, INC., Houston, TX (US)

(72) Inventors: Jerry Leroy Walker, Azle, TX (US); Jason Paul Metzger, Joshua, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/891,384

(22) PCT Filed: Jul. 19, 2013

(86) PCT No.: PCT/US2013/051207
§ 371 (c)(1),
(2) Date: Nov. 16, 2015

(87) PCT Pub. No.: WO2015/009312
PCT Pub. Date: Jan. 22, 2015

(65) Prior Publication Data

US 2016/0123709 A1 May 5, 2016

(51) Int. Cl.
*F42B 1/028* (2006.01)
*E21B 43/116* (2006.01)
*E21B 43/117* (2006.01)

(52) U.S. Cl.
CPC ..... *F42B 1/028* (2013.01); *E21B 43/116* (2013.01); *E21B 43/117* (2013.01)

(58) Field of Classification Search
CPC ..... F42B 1/02–1/028; F42B 1/032; E21B 43/117; E21B 43/116; E21B 43/118
See application file for complete search history.

(56) References Cited

U.S. PATENT DOCUMENTS 2,757,611 A * 8/1956 Church ..... F42B 1/024 102/307
3,267,853 A * 8/1966 Merendino ..... F41F 1/00 102/306
3,477,372 A * 11/1969 Nelson ..... F42B 1/028 102/307
4,466,353 A * 8/1984 Grace ..... F42B 1/02 102/307

(Continued)

FOREIGN PATENT DOCUMENTS

FR 1161445 A * 8/1958 ..... F42B 1/028
WO 2014193397 12/2014

OTHER PUBLICATIONS

International Patent Application No. PCT/US2013/051207 , Demand, filed Jul. 9, 2014, 11 pages.

(Continued)

*Primary Examiner* — Stephen Johnson
*Assistant Examiner* — Joshua T Semick
(74) *Attorney, Agent, or Firm* — Kilpatrick Townsend & Stockton LLP

(57) ABSTRACT

A shaped-charge liner for a shaped-charge assembly is provided. The shaped-charge assembly includes a housing, a liner, and explosive material between the housing and the liner. The liner includes an apex portion that has an opening and that defines a fold around the opening. The explosive material supports the apex portion.

17 Claims, 5 Drawing Sheets

(56) References Cited

U.S. PATENT DOCUMENTS

| | | | | |
|---|---|---|---|---|
| 4,829,901 | A * | 5/1989 | Yates, Jr. | F42B 1/024 102/306 |
| 5,394,804 | A * | 3/1995 | Cauchetier | F42B 1/02 102/308 |
| 6,349,649 | B1 * | 2/2002 | Jacoby | F42B 1/028 102/306 |
| 6,443,068 | B1 * | 9/2002 | Meister | F42B 1/028 102/306 |
| 6,644,205 | B2 * | 11/2003 | Ritman | F42B 3/00 102/307 |
| 8,375,859 | B2 * | 2/2013 | Sagebiel | F42B 1/028 102/306 |
| 9,175,936 | B1 * | 11/2015 | Collier | F42B 1/032 |
| 2001/0052303 | A1 | 12/2001 | Mayseless et al. | |
| 2002/0017214 | A1 | 2/2002 | Jacoby et al. | |
| 2009/0050321 | A1 | 2/2009 | Rhodes et al. | |
| 2009/0235836 | A1 | 9/2009 | Pratt et al. | |
| 2011/0088889 | A1 | 4/2011 | Grove et al. | |
| 2016/0153267 | A1 * | 6/2016 | Walker | E21B 43/114 166/298 |

OTHER PUBLICATIONS

International Patent Application No. PCT/US2013/051207 , International Preliminary Report on Patentability, dated Oct. 1, 2015, 7 pages.

International Patent Application No. PCT/US2013/051207, International Search Report and Written Opinion, dated Apr. 14, 2014, 11 pages.

* cited by examiner

SHAPED-CHARGE LINER WITH FOLD AROUND OPENING

CROSS-REFERENCE TO RELATED APPLICATIONS

This is a U.S. national phase under 35 U.S.C. § 371 of International Patent Application No. PCT/US2013/051207, titled "Shaped-Charge Liner with Fold around Opening" and filed Jul. 19, 2013, the entirety of which is incorporated herein by reference.

TECHNICAL FIELD

The present disclosure relates generally to a liner for a perforator to be located in a wellbore and, more particularly (although not necessarily exclusively), to a liner having a fold around an opening in an apex portion of the liner.

BACKGROUND

Hydrocarbons can be produced from wellbores drilled from the surface through a variety of producing and non-producing formations. A wellbore may be substantially vertical or may be offset. A variety of servicing operations can be performed on a wellbore after it has been initially drilled. For example, a lateral junction can be set in the wellbore at the intersection of two lateral wellbores or at the intersection of a lateral wellbore with the main wellbore. A casing string can be set and cemented in the wellbore. A liner can be hung in the casing string. The casing string can be perforated by firing a perforation gun or perforation tool.

Perforation tools can include explosive charges that are detonated to fire for perforating a casing and create perforations or tunnels into a subterranean formation that is proximate to the wellbore. Creating a large perforation in casing is desirable.

DETAILED DESCRIPTION

Certain aspects and features relate to a shaped-charge liner for a well perforator. The liner may be parabolic shaped and it can have a radius around an opening in the liner. The radius can be folded into the liner and can be supported by explosive material. The folded and supported liner portions can cause a reverse detonation wave that can spread liner material until a hollow or donut-shaped jet is created, which can create a larger hole through casing to provide more flow area for hydrocarbons to enter a wellbore.

Using a shaped-charge assembly with a shaped-charge liner according to certain aspects to perforate a casing may reduce the velocity by which hydrocarbons enter the wellbore and it may help control sanding problems when hydrocarbons are produced from unconsolidated formations.

These illustrative aspects and examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
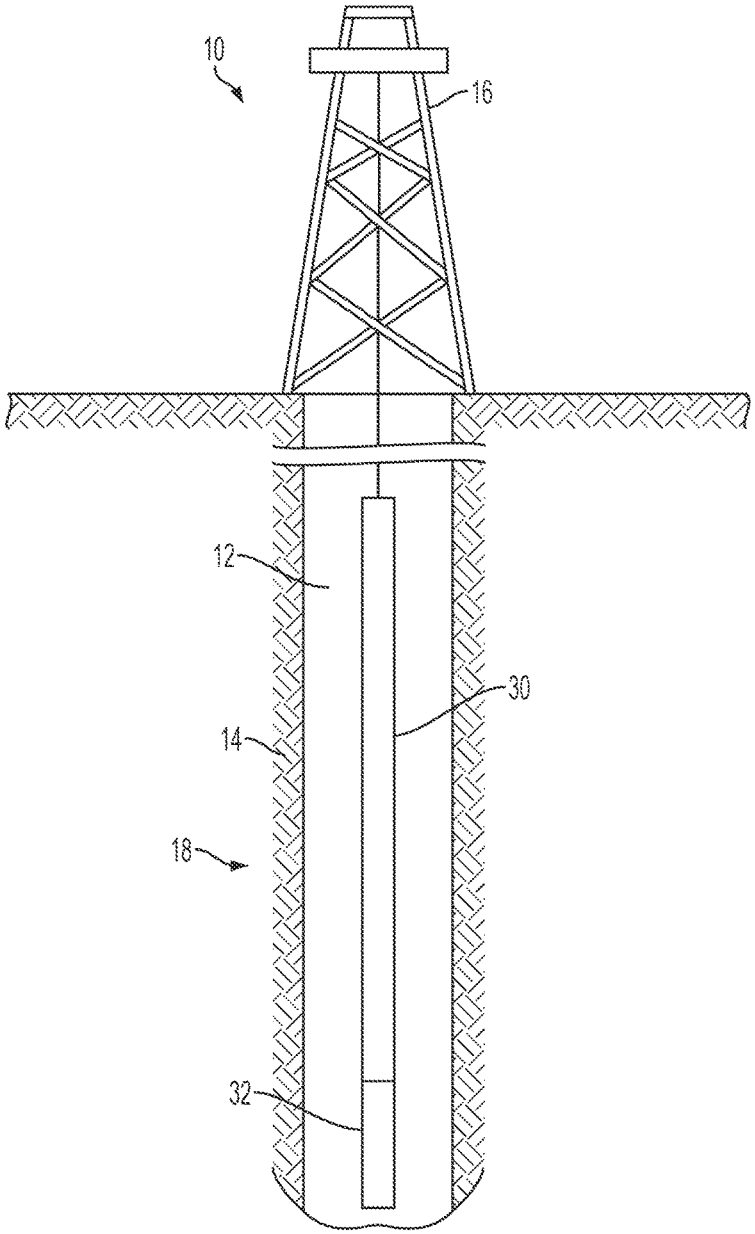
FIG. 1 is a schematic view of a wellbore that includes a perforation tool having a liner defining a fold about a liner opening according to one aspect.

FIG. 1 depicts an example of a wellbore servicing system 10 that includes a shaped-charge liner having a folded and supported portion. The system 10 includes a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in other examples the wellbore 12 may be deviated, horizontal, or curved over at least some portions of the wellbore 12. The wellbore 12 may be cased, open hole, contain tubing, and may include a hole in the ground having a variety of shapes or geometries.

The servicing rig 16 may be a drilling rig, a completion rig, a workover rig, a servicing rig, or other mast structure, or a combination. The servicing rig 16 can support a workstring 18 in the wellbore 12, but in other examples a different structure may support the workstring 18. For example, an injector head of a coiled tubing rigup can support the workstring 18. In some aspects, the servicing rig 16 may include a derrick with a rig floor through which the workstring 18 extends downward from the servicing rig 16 into the wellbore 12. The servicing rig 16 may be supported by piers extending downwards to a seabed in some implementations. Alternatively, the servicing rig 16 may be supported by columns sitting on hulls or pontoons (or both) that are ballasted below the water surface, which may be referred to as a semi-submersible platform or rig. In an off-shore location, a casing may extend from the servicing rig 16 to exclude sea water and contain drilling fluid returns. Other mechanical mechanisms that are not shown may control the run-in and withdrawal of the workstring 18 in the wellbore 12. Examples of these other mechanical mechanisms include a draw works coupled to a hoisting apparatus, a slickline unit or a wireline unit including a winching apparatus, another servicing vehicle, and a coiled tubing unit.

The workstring 18 may include a conveyance 30, a perforation tool 32, and other tools or subassemblies (not shown) located above or below the perforation tool 32. The conveyance 30 may include any of a slickline, a coiled tubing, a string of jointed pipes, a wireline, and other conveyances for the perforation tool 32. The perforation tool 32 can include one or more explosive charges that may be triggered to explode for perforating a casing (if present), perforating a wall of the wellbore 12, and forming perforations or tunnels out into the formation 14. The perforating may promote recovering hydrocarbons from the formation 14 for production at the surface, storing hydrocarbons flowed into the formation 14, or disposing of carbon dioxide in the formation 14.

Figure 2:
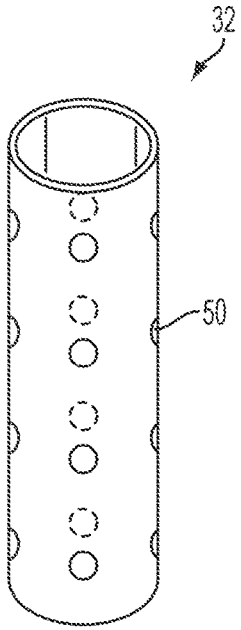
FIG. 2 is a perspective view of an example of a perforation tool according to one aspect.

FIG. 2 depicts by perspective view an example of the perforation tool 32 that includes a shaped-charge liner with a folded and supported portion. The perforation tool 32 includes one or more explosive shaped-charge assemblies 50. The perforation tool 32 may include a tool body (not shown) that contains the shaped-charge assemblies 50 and protects and seals them from the downhole environment prior to perforation. A surface of the tool body may be bored or countersunk, or both, proximate to the shaped-charge assemblies 50 to promote ease of perforation of the tool body by detonation of the shaped-charge assemblies 50. The tool body may be constructed out of various metal materials. The tool body may be constructed of one or more kinds of steel, including stainless steel, chromium steel, and other steels. Alternatively, the tool body may be constructed of other non-steel metals or metal alloys.

The shaped-charge assemblies 50 may be disposed in a first plane perpendicular to the axis of the tool body, and additional planes or rows of additional shaped-charge assemblies 50 may be positioned above and below the first plane. In one example, four shaped-charge assemblies 50 may be located in the same plane perpendicular to the axis of the tool body, and 90 degrees apart. In another example, three shaped-charge assemblies 50 may be located in the same plane perpendicular to the axis of the tool body, and 120 degrees apart. In other examples, however, more shaped-charge assemblies may be located in the same plane perpendicular to the axis of the tool body. The direction of the shaped-charge assemblies 50 may be offset by about 45 degrees between the first plane and a second plane, to promote more densely arranging the shaped-charge assemblies 50 within the tool body. The direction of the shaped-charge assemblies 50 may be offset by about 60 degrees between the first plane and a second plane, to promote more densely arranging the shaped-charge assemblies 50 within the tool body.

A frame structure (not shown) may be included in the tool body that retains the shaped-charge assemblies 50 in planes, oriented in a preferred direction, and with appropriate angular relationships between rows. In some aspects, a detonator cord couples to each of the shaped-charge assemblies 50 to detonate the shaped-charge assemblies 50. When the perforation tool 32 includes multiple planes or rows of shaped-charge assemblies 50, the detonator cord may be disposed on the center axis of the tool body. The detonator cord may couple to a detonator apparatus that is triggered by an electrical signal or a mechanical impulse, or by another trigger signal. When the detonator activates, a detonation can propagate through the detonation cord to each of the shaped-charge assemblies 50 to detonate each of the shaped-charge assemblies 50 substantially at the same time.

Figure 3:
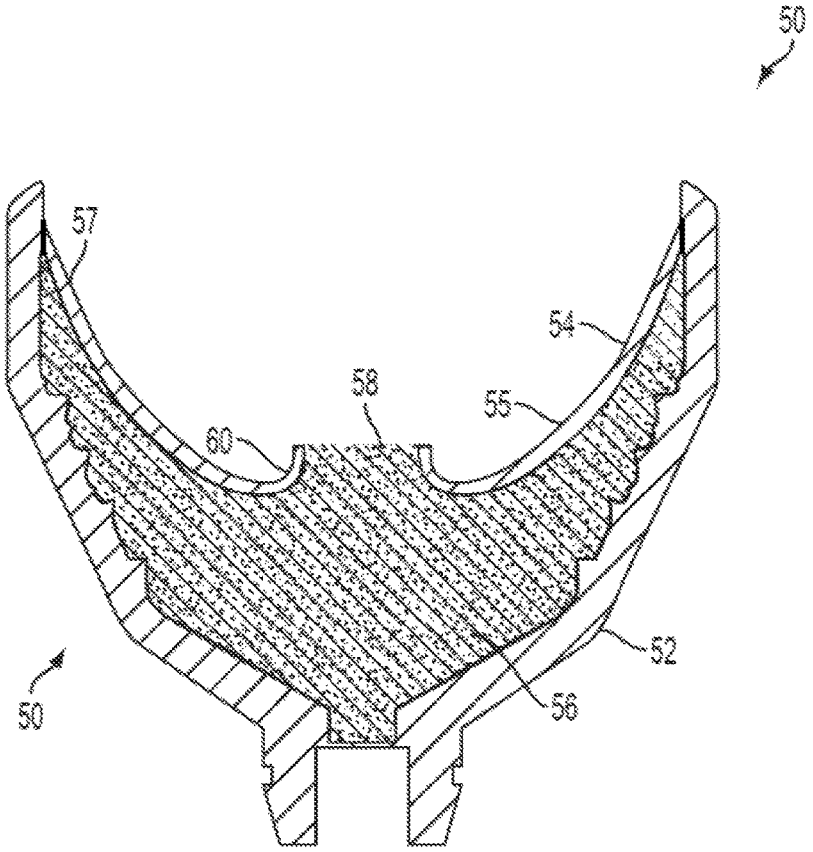
FIG. 3 is a cross-sectional view of a shaped-charge assembly for a perforation tool according to one aspect.

FIG. 3 depicts by cross section an example of a shaped-charge assembly 50 according to one aspect. The shaped-charge assembly 50 includes a housing 52, a liner 54, and explosive material 56 located between the liner 54 and the housing 52. The liner 54 can be separate from, but attached to, the housing 52. For example, the liner 54 can be attached to the housing 52 by a glue bead or other mechanical mechanism.

The liner 54 can include an apex portion 55 and a skirt portion 57. The skirt portion 57 may be coupled to the housing 52. The apex portion 55 can include a radius defining an opening 58 in the liner 54. The size of the opening 58 may vary, for example from 0.0001 inches to one inch. An apex portion of the liner 54 around the opening 58 defines a fold 60. For example, part of the apex portion can be constructed, such as by being turned up, to define the fold 60. In some aspects, the fold 60 is curved.

The explosive material 56 supports the liner 54, including the fold 60. The explosive material 56 supports the liner 54 by abutting one side of the liner 54. In some aspects, the explosive material 56 supports the fold 60 by being located up to the opening 58 in the liner 54. The liner 54 may be made from any suitable material. Examples of suitable materials from which the liner 54 can be made include brass, copper, steel, aluminum, zinc, lead, and uranium (or combinations of these and other suitable materials).

Figure 4:
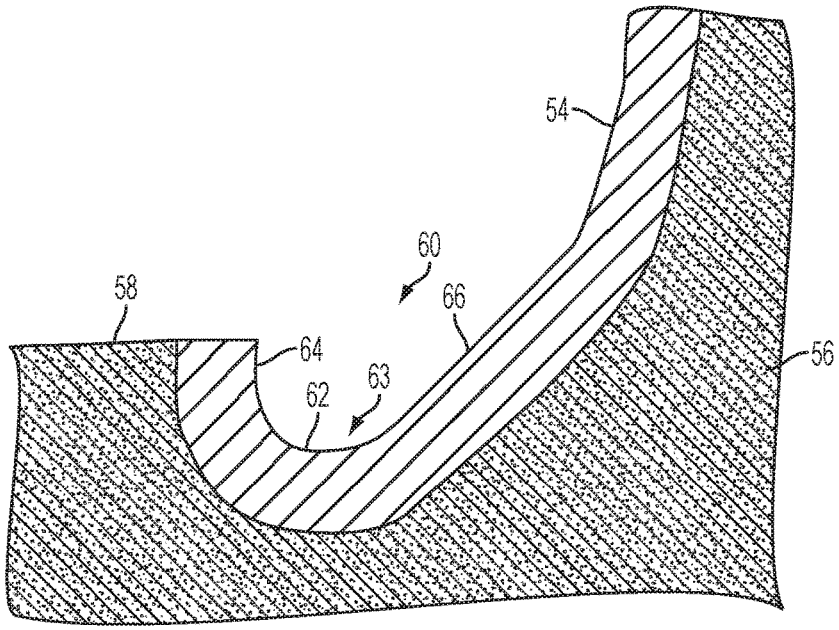
FIG. 4 is a cross-sectional view of part of a shaped-charge liner supported by explosive material according to one aspect.

FIG. 4 depicts by cross section part of the liner 54 and explosive material 56. The explosive material 56 supports the liner 54 up to the opening 58. The fold 60 defines a curved portion 62 between an opening side portion 64 of the liner 54 and a housing side portion 66 of the liner 54. The opening side portion 64 is closer to the opening 58 than the housing side portion 66. The opening side portion 64 can be completely supported by the explosive material 56. The opening side portion 64 can be on the same plane as the housing side portion 66 and the curved portion 62 can be on a different plane than the opening side portion 64 and the housing side portion 66. For example, the curved portion 62 can be below the opening side portion 64 and the housing side portion 66. The opening side portion 64 can extend from the curved portion 62 in a direction that is generally toward the skirt portion, or otherwise toward plane on which the skirt portion is located.

In other aspects, the fold 60 does not define a curve. For example, the fold 60 may define a 90 degree angle between the opening side portion 64 and the housing side portion 66, in which a middle portion 63 is defined between the opening side portion 64 and the housing side portion 66. The middle portion 63 can be on a different plane than the opening side portion 64 and the housing side portion 66.

Figure 5:
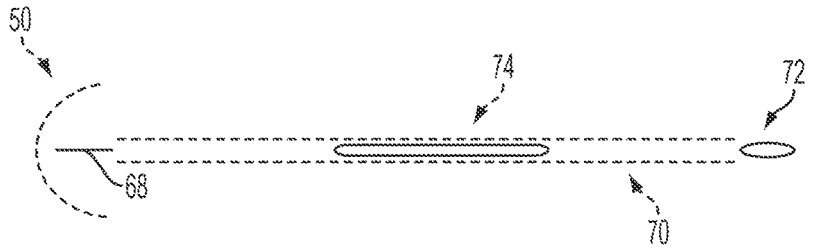
FIG. 5 is a diagram of an explosive jet from a shaped-charge assembly according to one aspect.

FIG. 5 depicts an example of a detonation jet of the shaped-charge assembly 50. When the shaped charge in the shaped-charge assembly 50 is detonated, for example by the propagation of a detonation from the detonator cord to the shaped charge, the energy of the detonation can be concentrated or focused along an explosive focus axis 68, forming a detonation jet 70 indicated by the dotted line. A portion of the shaped-charge liner 54 may form a projectile 72 that is accelerated by the energy of detonation and forms the leading edge of the detonation jet 70 as it penetrates into casing. Another portion of the shaped-charge liner 54 may form a slug 74 that moves more slowly and lags behind the projectile 72. Using a shaped-charge liner 54 having a portion around an opening folded and supported by explosive material can help the projectile 72 spread and concentrate the force from the projectile 72 so that a larger perforation opening is created in a casing.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A shaped-charge assembly, comprising:

a housing;

a liner that includes an apex portion having an opening and part of the liner around the opening that defines a fold, wherein the opening is internal to a plane defined by where the liner meets the housing; and explosive material between the housing and the apex portion and supporting the apex portion, wherein a portion of the explosive material is closer to a skirt portion of the liner that is connected to the housing than to a middle portion of the apex portion to cause a reverse detonation wave that spreads a portion of the liner to guide a perforation jet axially from a center of the apex portion and to be hollow or donut-shaped based on a shape of the liner, the explosive material being positioned in the apex portion proximate to the opening for supporting the fold, wherein the shaped-charge assembly is positionable in a perforation tool positioned in a wellbore for performing a wellbore operation.

2. The shaped-charge assembly of claim 1, wherein the apex portion includes:

a housing side portion; and an opening side portion that is closer to the opening than the housing side portion;

wherein the middle portion is between the opening side portion and the housing side portion, the middle portion being at a different plane than the housing side portion and the opening side portion.

3. The shaped-charge assembly of claim 2, wherein the middle portion is a curved portion.

4. The shaped-charge assembly of claim 1, wherein part of the liner extends toward a skirt portion of the liner that is connected to the housing.

5. The shaped-charge assembly of claim 1, wherein the explosive material supports the apex portion by abutting one side of the apex portion.

6. A shaped-charge liner for a downhole shaped-charge assembly, the shaped-charge liner comprising:

a skirt portion connectable to a housing of the downhole shaped-charge assembly;

an apex portion that includes an opening and that defines a fold around the opening, wherein the opening is internal to a plane defined by where the skirt portion is connectable to the housing, the apex portion including a part of an opening side portion that is closer to the skirt portion than to a middle portion of the apex portion, the apex portion also being supportable by explosive material positioned in the apex portion proximate to the opening for supporting the fold and for causing a reverse detonation wave that spreads a portion of the shaped-charge liner to guide a perforation jet axially from a center of the apex portion and to be hollow or donut-shaped based on a shape of the liner, wherein the downhole shaped-charge assembly is positionable in a perforation tool positioned in a wellbore for performing a wellbore operation.

7. The shaped-charge liner of claim 6, wherein the apex portion includes a housing side portion, and wherein the middle portion is between the opening side portion and the housing side portion and is at a different plane than the housing side portion and the opening side portion.

8. The shaped-charge liner of claim 7, wherein the middle portion is a curved portion.

9. The shaped-charge liner of claim 7, wherein the opening side portion extends toward the skirt portion.

10. A perforation tool, comprising:

a shaped-charge assembly positionable in a wellbore for performing downhole operations, the shaped charge assembly including:

a housing;

a liner having a skirt portion connected to the housing and an apex portion that has an opening and that defines a fold around the opening, wherein the opening is internal to a plane defined by where the skirt portion meets the housing; and explosive material supporting the apex portion, wherein a portion of the explosive material is closer to the skirt portion than to a middle portion of the apex portion to cause a reverse detonation wave that spreads a portion of the liner to guide a perforation jet axially from a center of the apex portion and to be hollow or donut-shaped based on a shape of the liner, the explosive material being positioned in the apex portion proximate to the opening for supporting the fold.

11. The perforation tool of claim 10, wherein the apex portion includes:

a housing side portion; and an opening side portion that is closer to the opening than the housing side portion;

wherein the middle portion is between the opening side portion and the housing side portion, the middle portion being at a different plane than the housing side portion and the opening side portion.

12. The perforation tool of claim 11, wherein the middle portion is a curved portion.

13. The perforation tool of claim 11, wherein the opening side portion extends toward the skirt portion.

14. The perforation tool of claim 10, wherein the explosive material supports the apex portion by abutting one side of the apex portion.

15. The shaped-charge assembly of claim 2, wherein the skirt portion of the liner includes a first end that is connected to the housing and a second end that is coupled to the housing side portion of the apex portion of the liner, the skirt portion extending from the housing side portion in a different plane than the housing side portion.

16. The shaped-charge liner of claim 7, wherein the skirt portion is coupled to the housing side portion of the apex portion, the skirt portion extending from the housing side portion in a different plane than the housing side portion, the different plane being at a different angle in relation to a horizontal plane than the housing side portion.

17. The perforation tool of claim 10 wherein the shaped-charge assembly comprises a plurality of shape-charge assemblies disposed in both a first plane and an additional plane, both the first plane and the additional plane being perpendicular to an axis of the perforation tool.

* * * * *